United States Patent [19]

Hill

[11] Patent Number: 4,645,079

[45] Date of Patent: Feb. 24, 1987

[54] SHIPPING AND STORING SUPPORT

[75] Inventor: Robert C. B. Hill, Greenville, N.C.

[73] Assignee: Coulter Electronics,Inc., Hialeah, Fla.

[21] Appl. No.: 659,202

[22] Filed: Oct. 9, 1984

[51] Int. Cl.[4] ..... B65D 5/50; B65D 85/62

[52] U.S. Cl. ..... 206/563; 206/480; 206/564; 206/443; 206/526; 206/370

[58] Field of Search ..... 206/563, 526, 527, 318, 206/443, 387, 370, 480, 564, 366; 221/241

[56] References Cited

U.S. PATENT DOCUMENTS

| | | | |
|---|---|---|---|
| 2,883,061 | 4/1959 | Moore | 206/480 |
| 3,013,656 | 12/1961 | Murphy, Jr. | 206/564 |
| 3,080,964 | 3/1963 | Robinson et al. | 206/318 |
| 3,207,302 | 9/1965 | Hobbs | 206/366 |
| 3,469,686 | 9/1969 | Gutsche et al. | 206/564 |
| 4,132,311 | 1/1979 | Glinert | 206/563 |
| 4,159,769 | 7/1979 | Hatten et al. | 221/241 |
| 4,361,226 | 11/1982 | Travis | 206/564 |

*Primary Examiner*—William Price
*Assistant Examiner*—Brenda J. Ehrhardt
*Attorney, Agent, or Firm*—Gerald R. Hibnick; Pamela A. Simonton

[57] ABSTRACT

A shipping and storing support having recesses so constructed and arranged to ship and store selectively a plurality of articles having varying dimensions, the recesses having a plurality of internal contours for selectively receiving the articles to be retained therein by a frictional fit and wherein the plurality of internal contours of the recesses have substantially the same contour as a portion of the plurality of different sized articles adapted to be received frictionally in said recesses.

8 Claims, 7 Drawing Figures

SHIPPING AND STORING SUPPORT

BACKGROUND AND PRIOR ART

This invention relates to shipping and storing supports for selectively housing a plurality of articles having varying or different dimensions.

It is a commonplace for controls and reagents used in diagnostic and industrial testing to be shipped and stored in a plurality of different sized articles. The articles can include vials and bottles of various sizes and shapes. The articles can have a generally spherical or generally rectangular cross-sectional diameter. The size of the article can be based on the quantity of reagent needed. Additionally, a plurality of different products, liquid and powder, in a plurality of different sized articles can be supplied at the same time. The use of a plurality of different sized articles is a commonplace when the reagents are supplied in kit form.

A tight frictional fit of the article to be supported or retained in said support protects the article during shipping. A tight frictional fit also allows the articles to be oriented for handling and processing.

Tray-like holders for supporting objects having identical or substantially similiar lengths and substantially similar cross-sectional diameters for shipping and storing are well known. Examples of such tray-like holders include Weiss U.S. Pat. No. 3,467,247 and Jones U.S. Pat. No. 3,746,161. The Weiss patent relates to the supporting of elongated articles in compartments having generally U-shaped cross-sections. The Jones patent relates to supporting flat rectangular objects, such as microscope slides. Both Weiss and Jones provide tray-like holders with a plurality of recesses or compartments for the same sized article. Hecker U.S. Pat. No. 3,270,877 relates to the transport and handling of a plurality of generally similar columnar articles of varying lengths. Hecker provides a compartment with repetitive troughs of generally U-shaped configuration with a plurality of slits to restrain endwise or axial movement of the articles.

Other prior art devices, for example, Laraway and Rockwell U.S. Pat. No. 10,132 provide a recess for a specific article which conforms to the shape of the article. The recess accommodates only one specific article and is not adapted to accommodate a plurality of articles wherein the articles have different dimensions in relation to one another.

SUMMARY OF THE INVENTION

A shipping and storing support is provided to receive a plurality of different sized articles, the articles having varying or different lengths and varying or different cross-sectional diameters. The shipping and storing support comprises a base portion with at least one recess of a size to selectively receive articles at least partially therein in their supine position. Each recess has a plurality of internal contours for selectively receiving by a frictional fit articles of varying lengths and varying cross-sectional diameters. The plurality of internal contours of each recess are substantially the same as a portion of the external contours of the different size articles to be retained therein. The invention allows a plurality of different sized articles to be selectively retained in identical shaped recesses in the same support for shipping and storing.

This invention is an improvement over tray-like holders with recesses to retain articles having identical or substantially similar cross-sectional diameters and articles having identical or substantially similiar cross-sectional diameters in combination with different lengths. It also eliminates the need to provide a specific tray-like support for each combination of articles to be retained therein. Further, a change in the shape or number of articles to be retained in the support does not require a different display support be prepared to accommodate these changes in the dimensions or number of the articles.

This invention provides a shipping and storing support that will selectively accommodate a plurality of articles having varying dimensions, including different lengths and different cross-sectional diameters, by a frictional fit in the same recess. It provides a shipping and storing support that will selectively accommodate a plurality of different combinations of articles in identical recesses.

This invention provides a frictional fit in said recess for a plurality of articles having varying dimensions, including varying lengths and varying cross-sectional diameters, that protects the products during shipment and provides a frictional fit that orients the articles for handling and processing.

DETAILED DESCRIPTION OF THE PREFERRED EMBODIMENT

Figure 1:
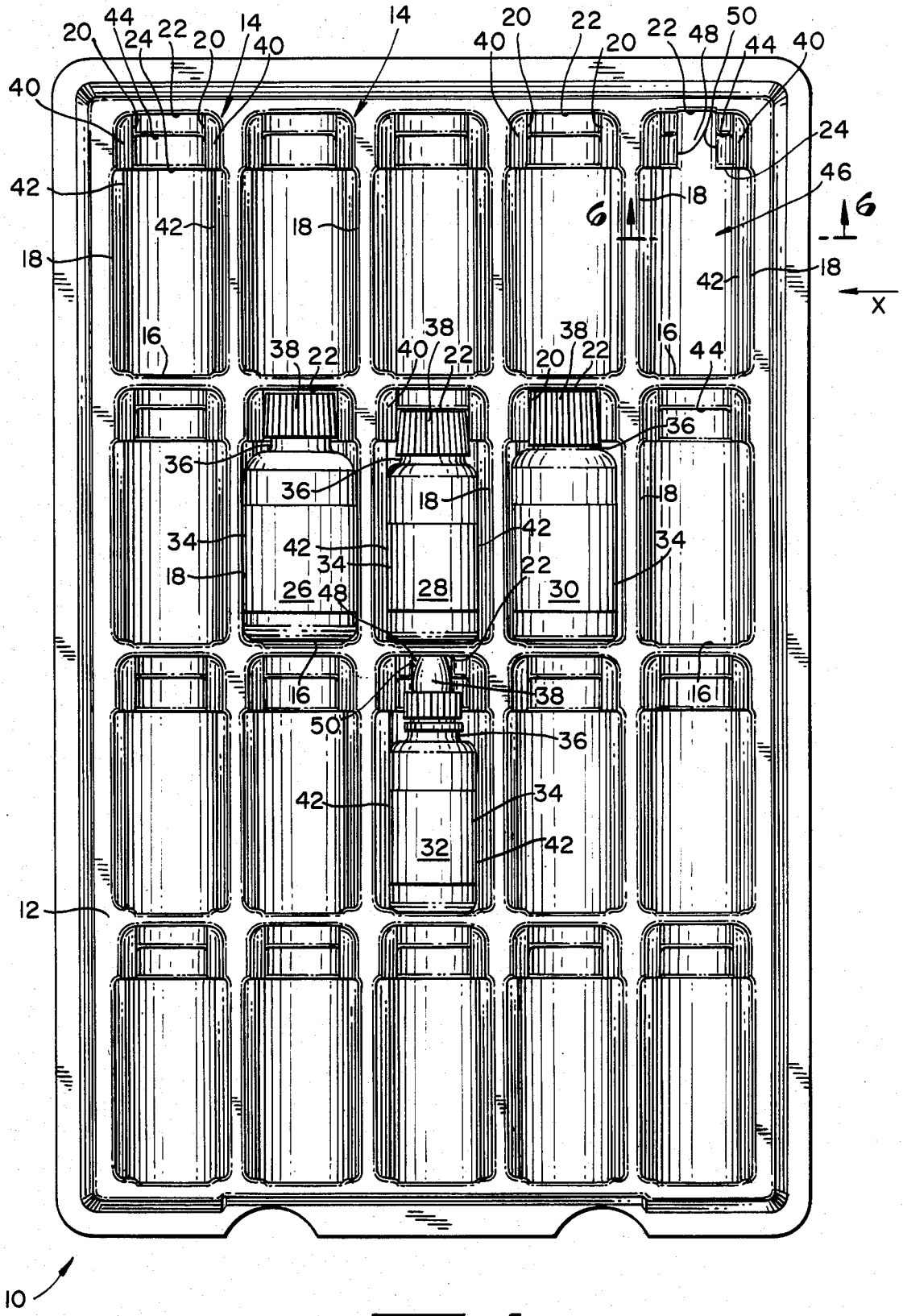
FIG. 1 is a top plan view of the shipping and storing support including recesses of different configurations holding several reagent bottles of different dimensions.
Figure 2:
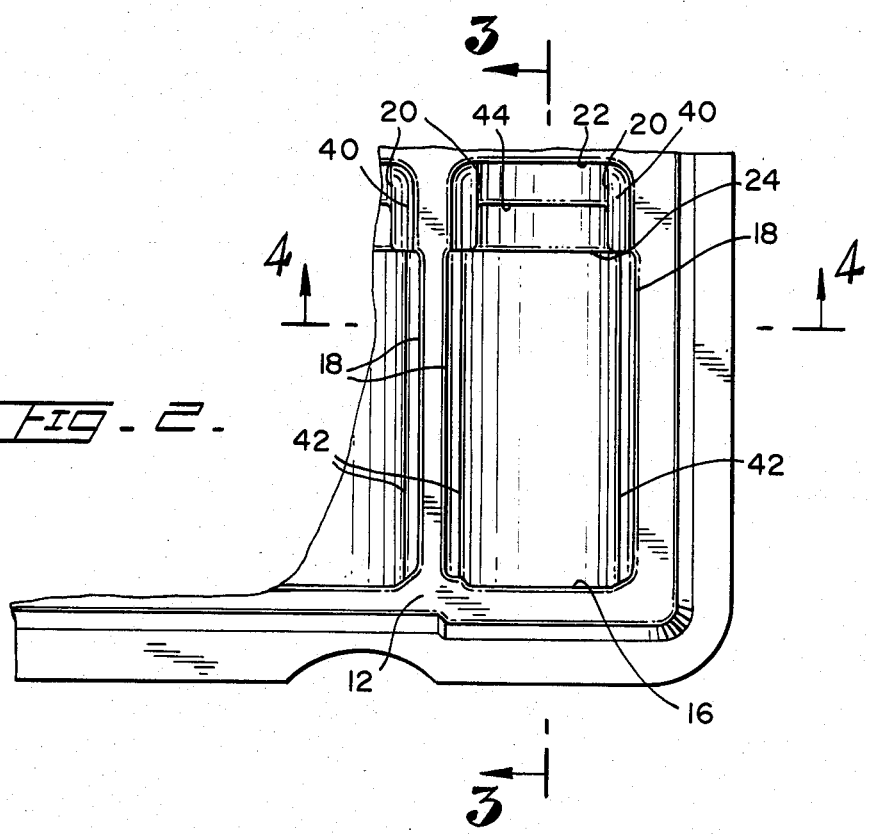
FIG. 2 is a top plan, partial enlarged view of one recess of the shipping and storing support of FIG. 1.
Figure 3:
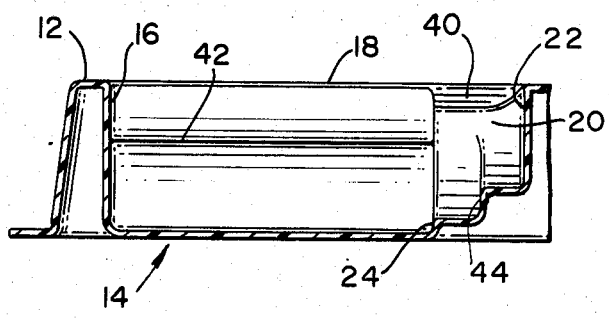
FIG. 3 is a cross-sectional view taken along line 3—3 of FIG. 2.
Figure 4:
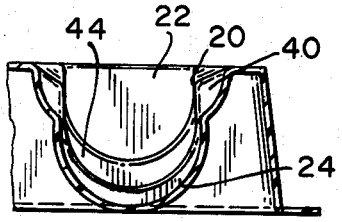
FIG. 4 is a cross-sectional view taken along line 4—4 of FIG. 2.

A shipping and storing support 10 is so constructed and arranged to selectively receive a plurality of articles having varying dimensions. The articles to be selectively received can have different cross-sectional diameters and/or different lengths. The shipping and storing support 10 comprises a base portion 12 with at least one recess 14 of a size to selectively receive articles at least partially therein in their supine position. The articles are selectively received in the recess 14 by a frictional fit of the article between the internal contours of the recess 14. The recess 14 includes a plurality of internal contours for selectively receiving the articles of varying dimensions therein as shown in FIGS. 1 through 7. The internal contours of the recess 14 are formed by a plurality of ledges, which are generally parallel to the longitudinal axis of the recess as shown by line 3—3 in FIG. 2, and by a plurality of offsets, which are generally perpendicular to the longitudinal axis of the recess as shown by line 4—4 of FIG. 2. As shown in the preferred embodiment, the internal contours of the recess 14 have at least two pairs of ledges 18 and 20 and at least two offsets 16 and 22, whereby a first article of one external dimension can be received frictionally in said recess 14; or another article, having a different external dimension from the first article, can be received frictionally in said recess 14. To accommodate articles having both different cross-sectional diameters and different lengths, the internal contours would include at least two pairs of ledges and at least three offsets. The internal contours of recess 14 correspond to the external shape of at least a portion of the cross-sectional diameter of the articles to be received frictionally therein. The longitudinal axis of the recess 14 corresponds to the longitudinal axis of the articles to be received frictionally in the shipping and storing support 10.

The base portion 12 of the shipping and storing support 10 can include a plurality of recesses 14 as shown in FIG. 1. The recesses 14 have a general shape to accommodate the general shape of the article to be supported. For example, the articles shown in FIG. 1 include reagent bottles 26, 28, 30 and 32. The reagent bottles 26, 28, 30 and 32, in the example shown, each have a generally cylindrical shape with a container portion 34, a neck portion 36 and a closure portion 38. The neck portion 36 can have an external dimension smaller than the external dimension of the container portion 34. As will be seen from the reagent bottles 26, 28, 30 and 32, the cross-sectional diameters of each neck portion 36, each container portion 34 and/or each closure portion 38 can have different cross-sectional diameters or radii of curvature. Additionally, the lengths of the reagent bottles 26, 28, 30 and 32 can vary.

The internal contours and the general external shape form the walls of the recess 14 and correspond to the external dimension of a plurality of different articles to be selectively, frictionally, received therein. The number and shape of recesses 14 and the internal contours of the recesses 14 can vary with the types and shapes of articles to be stored. The recesses 14 can be arranged in a plurality of columns and rows. For example as shown in FIGS. 1–4 and 6, the internal contours can include a plurality of pairs of ledges 18, 20, 40, and 42 and a plurality of offsets 16, 22, 24, and 44. The internal contours correspond to the external dimension of at least one of the container portion 34, the neck portion 36 and the closure portion 38. A portion of the cross-sectional diameter of the articles is accommodated by the pairs of ledges 18, 20, 40 and 42. The length of the articles is accommodated by the offsets 16, 22, 24 and 46. In the shipping and storing support 10, as shown in FIG. 1, the reagent bottle 26 is received frictionally in the recess 14 by the pair of ledges 18, which correspond to a portion of the external diameter of the container portion 34, and by the pair of ledges 40, which correspond to a portion of the external diameter of the closure portion 38. The offsets 16 and 22 receive the reagent bottle 26 along its length or longitudinal axis. The reagent bottle 28 is received frictionally in the recess 14 by the pair of ledges 42, which correspond to a portion of the external diameter of the container portion 34, and by the pair of ledges 40, which correspond to a portion of the external diameter of the closure portion 38. The offsets 16 and 46 receive the reagent bottle 28 along its length or longitudinal axis. The reagent bottle 30 is received frictionally in the recess 14 by the pair of ledges 18, which correspond to a portion of the external diameter of the container portion 34, and by the pair of ledges 40 which correspond to a portion of the external diameter of the closure portion 38. The offsets 16 and 22 receive the reagent bottle 30 along its length or longitudinal axis. The snug fit of the articles of varying dimensions in the recess 14 by the plurality of internal contours allows the articles to be protected during shipment and also allows the articles to be oriented for handling and processing.

Figure 5:
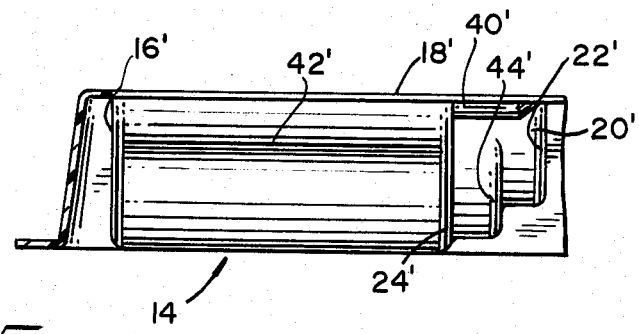
FIG. 5 is a side view of the support, including the recess of the one configuration that was shown in FIG. 3 along line 3—3 of FIG. 1.

FIG. 5 shows the exterior side of the recess 14 with the plurality of the ledges 18', 20', 40' and 42' and the plurality of the offsets 16', 22', 24' and 44' to accommodate a plurality of articles of varying dimensions. The prime figures correspond to the ledges and offsets forming the internal contours shown in the corresponding cross-sectional and plan views.

Figure 6:
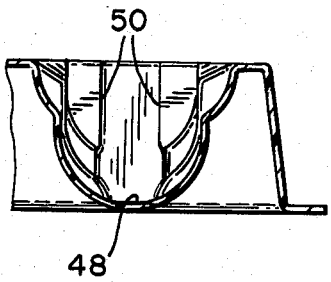
FIG. 6 is an enlarged cross-sectional view of another configuration of a recess taken along line 6—6 of FIG. 1.
Figure 7:
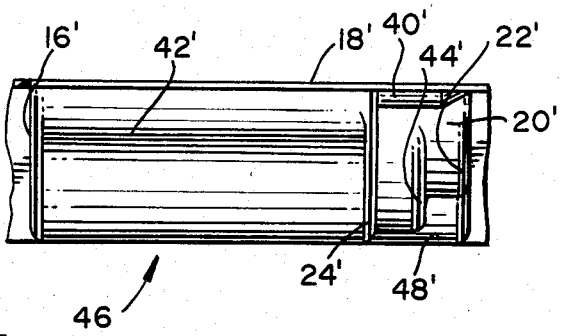
FIG. 7 is an exterior side view of the recess in FIGS. 1 and 6 looking in the direction of arrow X on FIG. 1.

The general shape of the recess 14 and the internal contours of the recess 14 can be adapted to various different shaped articles. For example, the shipping and storing support 10 can be generally rectangular in shape with internal contours corresponding to a plurality of generally rectangular shaped articles having varying cross-sectional diameters and varying lengths. Additionally, specially shaped articles can be received selectively by the internal contours of the recess as shown in FIGS. 1, 6 and 7. The reagent bottle 32 is an example of a specially shaped article. A second recess 46 includes a trough 48 formed by the pair of ledges 50 to accommodate the closure portion 38 of the article 32. The second recess 46 also can include the internal contours to selectively receive the articles 26, 28 and 30. FIG. 7 shows the exterior side of the recess 46 with the plurality of ledges 18', 20', 40', and 42' and the plurality of the offsets 16', 22', 24'and 44', as well as the trough 48'. Again, the prime numbers correspond to the ledges, offsets and trough forming the internal contours shown in the corresponding cross-sectional and plan views.

One now should appreciate that one could utilize a pair of ledges to correspond to different portions of the cross-sectional diameters of a plurality of articles and a set of offsets to correspond to the length or longitudinal axis of a plurality of articles. The combination of pairs of ledges and sets of offsets would vary with the types and shapes of articles to be housed in the shipping and storing support 10. For example, a pair of ledges could be provided to grip the neck portion of an article. Further, a plurality of sets of offsets could be provided to correspond to articles of varying lengths. It readily can be seen that a shipping and storing support 10 having a plurality of identical recesses 14 or a plurality of different recesses, such as recess 14 and second recess 46, having a plurality of internal contours provide a universal, multi-purpose support for a single article or plurality of articles having varying dimensions and for a plurality of different combinations of articles. A shipping and storing support 10 may accommodate a single product.

The preferred embodiment benefits by use of a material having elastic or resilient properties. The ability of the material to return to its initial form or state following deformation as the article is received in the recess results in the article being retained in the recess frictionally and/or by a snap fit. For example, material such as polystyrene and ABS (acrylonitrobutadiene styrene) can be used to form the recesses.

Although particular embodiments of the invention have been shown and described here, there is no intention thereby to limit the invention to the details of such embodiments. On the contrary, the intention is to cover all modifications, alternatives, embodiments, usages and equivalents of the subject invention as fall within the spirit and scope of the invention, specifications and appended claims.

What is claimed and desired to be secured by Letters Patent of the United States is:

1. A shipping and storing support for housing a plurality of differently shaped articles in a recess comprising: a base including at least one recess of a size sufficient to receive selectively and frictionally therein articles at least partially in their supine position; said recess having a plurality of internal contours for selectively receiving therein, at different times, a plurality of articles of different cross-sectional diameters; some of said internal contours being of the same size as a portion of the external dimensions of the differently shaped articles; said recess including a longitudinal axis; and at least three of said internal contours being generally parallel to said axis to accommodate different articles of different cross-sectional diameters.

2. A shipping and storing support as defined in claim 1 wherein certain of said internal contours lie perpendicular to said axis to accommodate articles of different lengths.

3. A shipping and storing support as defined in claim 1 wherein said base includes a plurality of identical of said recesses, whereby at least some of said contours can be used to receive frictionally a first article of one external dimension in one of said recesses and contours of another of said identical recesses can be used to receive frictionally a second article having an external dimension different from the first article, the contours so used of said another recess being different from said some contours so used of said one recess.

4. A shipping and storing support as defined in claim 3 wherein said recesses are arranged in columns and rows in said base.

5. A shipping and storing support as defined in claim 1 wherein said contours are of a size and said base is of a material which cause the article being received frictionally in said recess to be held by a snap fit.

6. A shipping and storing support as defined in claim 1 wherein the articles can be of different lengths and cross-sectional diameters, and said internal contours include at least two pairs of ledges generally parallel to said axis and at least three offsets generally perpendicular to said axis, for selectively and frictionally receiving articles which differ in both length and cross-sectional diameter with respect to one another.

7. A shipping and storing support as defined in claim 1 wherein the articles to be received selectively and frictionally by said recess include reagent bottles having different radii of curvature; the reagent bottles have a container portion, a neck portion having a smaller dimension than the container portion, and a closure portion on the end of the neck portion closing the neck portion; and said internal contours are of different radii of curvature corresponding to the different radii of curvature of the external shape of at least one of the neck portion, the container portion, and the closure portion, for selectively frictionally receiving the reagent bottles in said recess.

8. A shipping and storing support as defined in claim 7 wherein the articles to be received selectively and frictionally include reagent bottles having different lengths, and wherein certain of said internal contours lie perpendicular to said axis for receiving, at different times, articles having different lengths.

* * * * *